US007030598B1

(12) United States Patent
Dow

(10) Patent No.: US 7,030,598 B1
(45) Date of Patent: Apr. 18, 2006

(54) LOW DROPOUT VOLTAGE REGULATOR

(75) Inventor: Ronald Neal Dow, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/636,340

(22) Filed: Aug. 6, 2003

(51) Int. Cl.
*G05F 3/16* (2006.01)

(52) U.S. Cl. ..... 323/313

(58) Field of Classification Search ..... 323/312, 323/313, 314
See application file for complete search history.

(56) References Cited

U.S. PATENT DOCUMENTS 5,410,241 A * 4/1995 Cecil ..... 323/315
5,781,002 A * 7/1998 O'Neill ..... 323/299
6,150,872 A * 11/2000 McNeill et al. ..... 327/539

OTHER PUBLICATIONS

Ferranti Interdesign, Inc., "301 Analog IC Designs; Functional Blocks for Macrochip Semicustom Integrated Circuits," 1987, p. 48.
Grey and Meyer, "Analog Integrated Circuits," 1977, pp. 258-261.

* cited by examiner

*Primary Examiner*—Adolf Berhane

(57) ABSTRACT

A low dropout voltage regulator. The regulator comprises a bandgap reference circuit and first and second transistors coupled in parallel. The parallel transistors form the input of an operational amplifier, coupled to and providing substantially no load to the bandgap reference circuit. The bandgap reference circuit is coupled to the output of the integrated circuit low dropout voltage regulator. As a beneficial result, the bandgap reference works from a regulated output and has substantially no load. Consequently, the voltage output of the present invention is highly stable.

19 Claims, 2 Drawing Sheets

LOW DROPOUT VOLTAGE REGULATOR

TECHNICAL FIELD

Embodiments of the present invention relate to power supplies and voltage regulation. More particularly, embodiments of the present invention provide a low dropout voltage regulator.

BACKGROUND ART

Voltage regulators as a part of direct current power supplies are a ubiquitous, if often unseen part of modern life. Almost all electronic devices contain a regulated power supply. Semiconductor devices generally operate at a relatively low direct current voltage, for example 5 volts. Much of the electrical energy to power electronic devices is made available at different voltages. For example, mains power in the United States is nominally 120 volts AC. Automotive power is nominally 12 or 24 volts DC, but is subject to high voltage transients, for example 60 volts, during engine start and other conditions of changing loads.

Power supplies are generally employed to match the requirements of electronic devices (and other types of machines) to the available conditions of electrical power. Many devices, for example hand held electronics, powered by batteries nominally within the voltage range of the electronics employ power supplies to compensate for non-linear discharge characteristics of batteries and to extract as much energy from the batteries as possible.

An important part of most power supplies is a voltage regulator. Voltage regulators function to maintain voltage (and/or current) within a range of output values, for example five volts plus or minus two percent (5 v+/−2%). It is generally important to maintain an output voltage within the specified range. Too high a voltage may damage semiconductor devices, leading to decreased reliability or outright failure. If the voltage goes too low, voltage compliance is lost on many components which may lead to several types of failure. In addition, changes in power supply voltage may induce noise into subsequent processing.

An important part of most voltage regulators is a voltage reference. A voltage reference provides a reference voltage that is compared against the output of the voltage regulator. Circuitry within the voltage regulator adjusts the output of the voltage regulator to have a desirable relationship to the voltage reference.

A "bandgap" is generally understood to refer to or to describe the energy difference between the top of the valence band and the bottom of the conduction band in insulators and semiconductors. Bandgaps are a well known source of reference voltages within integrated circuits.

In order to accommodate a voltage regulator having a variety of output voltages, e.g., 1.8 volts, 3.3 volts, 5 volts, etc., it is desirable to create a bandgap voltage reference based upon a minimum bandgap voltage. For silicon-based integrated circuits, this minimum bandgap voltage is generally 1.25 volts. In addition, a very high power supply rejection ratio is desirable as such rejection ratio affects the size of a required compensation capacitor (both in terms of capacitance and physical size) required on the regulator output. Generally, a higher power supply rejection ratio enables a smaller output capacitor. Unfortunately, conventional bandgap voltage reference designs offer less than desirable power supply rejection ratios, comprise too high a reference voltage, require an unfavorably large integrated circuit area and/or require undesirably large output filtering capacitors.

Accordingly, it is desirable to provide a system and method for a bandgap reference. A further desire exists for providing a bandgap reference with a high power supply rejection ratio and a favorably small integrated circuit area while requiring a small output filtering capacitor. A still further desire exists for the above-mentioned capabilities to be achieved in a manner that is complimentary and compatible with standard semiconductor processes.

DISCLOSURE OF THE INVENTION

Embodiments in accordance with the present invention provide a system and method for a low dropout voltage regulator. Further embodiments in accordance with the present invention provide for a bandgap reference with a high power supply rejection ratio while requiring a small output filtering capacitor. Embodiments in accordance with the present invention provide for the above-mentioned capabilities in a manner that is complimentary and compatible with standard semiconductor processes.

A low dropout voltage regulator is disclosed. The regulator comprises a bandgap reference circuit and first and second transistors coupled in parallel. The parallel transistors form the input of an operational amplifier, coupled to and providing substantially no load to the bandgap reference circuit. The bandgap reference circuit is coupled to the output of the integrated circuit low dropout voltage regulator. As a beneficial result, the bandgap reference works from a regulated output and has substantially no load. Consequently, the voltage output of the present invention is highly stable.

BEST MODE FOR CARRYING OUT THE INVENTION

In the following detailed description of the present invention, low dropout voltage regulator, numerous specific details are set forth in order to provide a thorough understanding of the present invention. However, it will be recognized by one skilled in the art that the present invention may be practiced without these specific details or with equivalents thereof. In other instances, well-known methods, procedures, components, and circuits have not been described in detail so as not to unnecessarily obscure aspects of the present invention.

Low Dropout Voltage Regulator

Embodiments of the present invention are described in the context of integrated circuit power supplies. However, it is appreciated that embodiments of the present invention may be utilized in other areas of electronic design.

Figure 1:
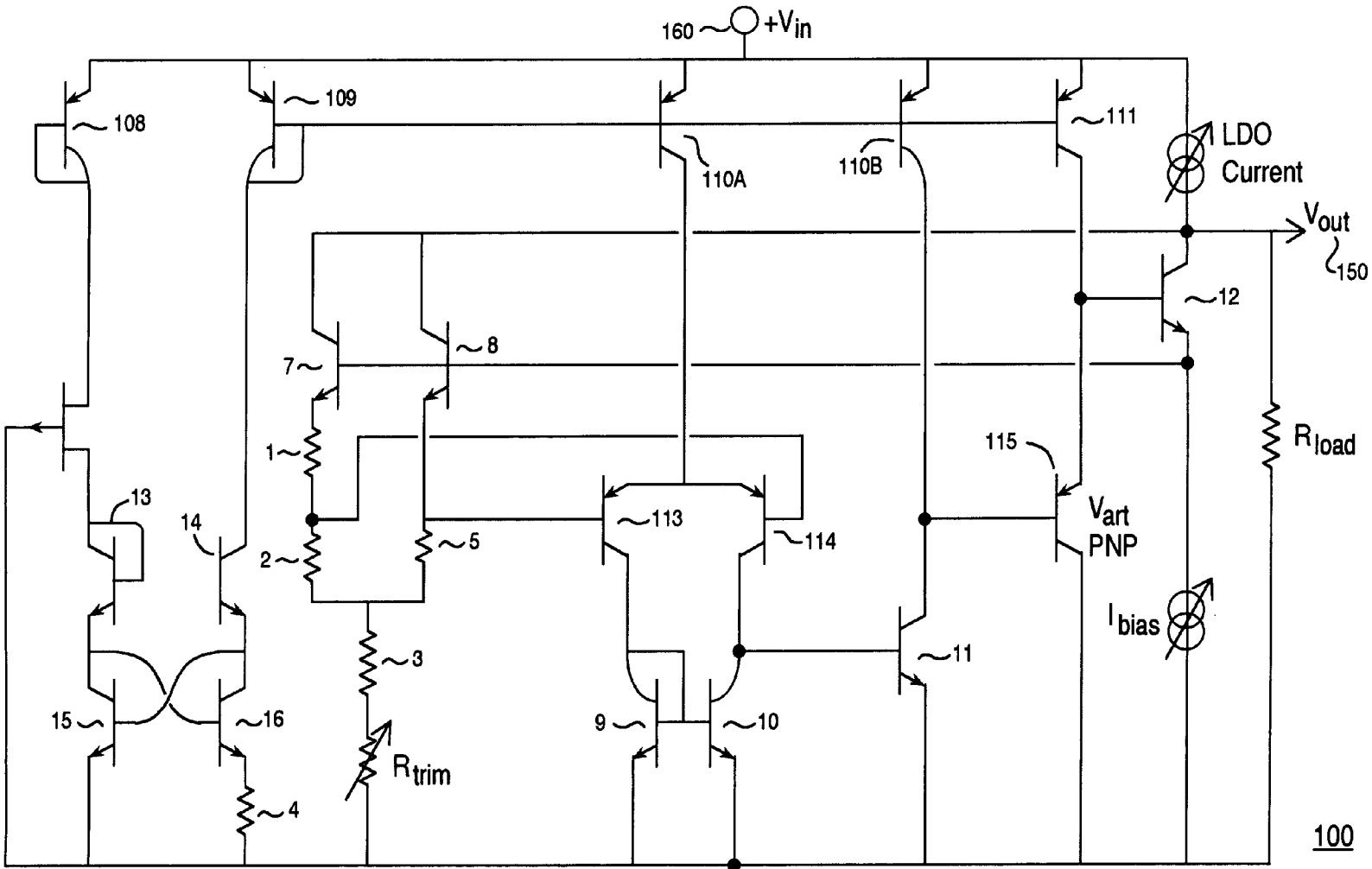
FIG. 1 is a schematic diagram of a low dropout voltage regulator, in accordance with embodiments of the present invention.

FIG. 1 is a schematic diagram of a low dropout voltage regulator 100, in accordance with embodiments of the present invention. Transistors 13, 14, 15 and 16, and implant resistor R4 from the emitter of transistor 16 to ground, establish a Proportional to Absolute Temperature (PTAT) offset voltage. Transistors 13, 14, 15 and 16 with resistor 4 are more fully described in commonly owned U.S. Pat. No. 3,930,172 to Dobkin, which is hereby incorporated herein by reference in its entirety. Implant resistor R4 has a positive temperature coefficient (T.C.) of about 3300 ppm/° C. Consequently, the current coming out of transistor 14 is approximately constant amplitude independent of the supply voltage of about 450 nA over temperature. This PTAT circuit is used to bias the bandgap through transistors 110A, 110B and 111, which are "constant" except for Early effects. It is to be appreciated that transistors 110A and 110B are "X0.5", e.g., half-size, devices. A common emitter establishes the biasing in these transistors and both collector voltages are at approximately 1.25V. The input stage, transistors 113 and 114, each have betas of about 1200. The bases of these devices are biased off of the emitters of transistors 7 and 8. Since both transistors 7 and 8 are designed to pass equal amounts of current, there is no error associated with this biasing. There are no input referred offsets with this biasing scheme particularly since the beta for the vertical PNP device, transistor 115 operating at about twice the current as transistor 110B, is about 2000. The emitter of transistor 115 is connected to base of NPN transistor 12, whose emitter is coupled to the 1.25V bandgap and whose collector to coupled to the output reference voltage. The Ibias variable current source is derived from the logarithm of a small fraction of the low drop out (LDO) output current source transistor and a fixed bias current source.

The supply rejection ratio is significantly improved by connecting the bandgap collectors of transistors 7 and 8 to the regulated output voltage of the device rather than Vin 160. Alternatively, the collectors of transistors 7 and 8 can be coupled to a separately derived bandgap voltage. The biasing of transistors 7 and 8 is improved by making the currents equal in the two legs by making the resistance of resistor 2 and resistor 5 about equal. As a beneficial consequence, all of the current density differences come from making the geometries of the two transistors different. A thermal voltage appears across resistor 1. The bottoms of resistors 2 and 5 are coupled to resistor 3 to establish biasing and are terminated in trim network Rt. It is appreciated that the base voltage on transistors 113 and 114 are approximately equal. In experimental investigation, it was found that the circuit was stable without compensation on the 1.25V output. It is appreciated that a compensation capacitor is generally required on the Vout 150 output to ground. In experimental investigation, it was found that acceptable compensation was provided by a 6.8 microfarad capacitor from Vout 150 to ground. In an alternative configure using a separately derived bandgap voltage coupled to the collectors of transistors 7 and 8, acceptable compensation was provided by a 2.2 microfarad capacitor from Vout 150 to ground.

An unregulated voltage is applied to terminal Vin 160. Bandgap reference circuit 100 provides a regulated output at terminal Vout 150 that is about 250 mV less than the voltage applied to terminal Vin. For example, to produce a regulated output at terminal Vout 150 of 1.8 volts, about 2.05 volts should be applied to terminal Vin 160.

Transistors 7 and 8 go to the regulated output, Vout 150. The common mode rejection is greatly improved by regulating the bandgap reference from a fixed, regulated output. Common mode rejection ratios of about 85 dB are consequently achieved. Transistors 7 and 8 have a fixed size ratio to generate equal current densities through the resistor network. Resistors 2 and 5 are equal size resistors. The base voltages on transistors 113 and 114 are relatively equal. Transistor 11 is about two times transistor 10 or transistor 9.

In a particular process, NPN type transistors have a relatively low beta, while PNP type transistors have a very high beta, for example, beta values of around 2000 are not uncommon for vertical PNP type transistors. Transistor 115 provides a buffering function, while transistor 12 "turns around" the current. The collectors of transistors 7 and 8 are coupled to Vout 150. The emitter of transistor 12 is coupled to 1.25 volts.

Figure 2:
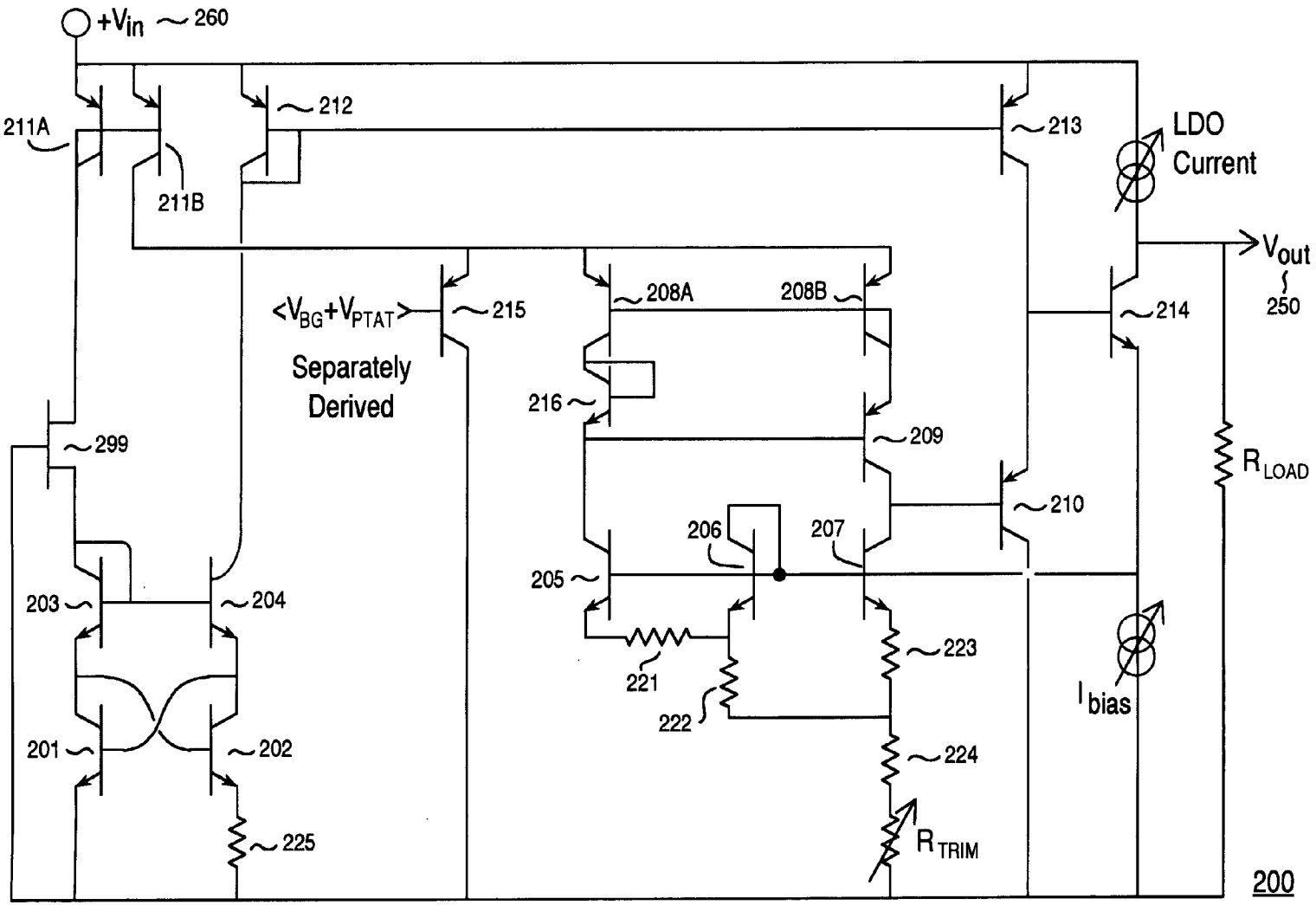
FIG. 2 is a schematic diagram of a low dropout voltage regulator, in accordance with embodiments of the present invention.

FIG. 2 is a schematic diagram of a low dropout voltage regulator 200, in accordance with embodiments of the present invention. As described with respect to FIG. 1, a Proportional to Absolute Temperature (PTAT) voltage source is applied across an implant resistor and the output current from transistor 204 is approximately constant with temperature and supply voltage. Transistors 201, 202, 203 and 204 with resistor 225 are more fully described in commonly owned U.S. Pat. No. 3,930,172 to Dobkin, which is hereby incorporated herein by reference in its entirety. An epitaxial field effect transistor 299 is connected to the input of the current source and to a PNP diode 211 to the positive supply. The diode is divided so the 211B can supply the 1.5 micro amps needed by transistor 208 and the voltage clamp 215.

The voltage on the base of transistor 215 is derived from a separate bandgap from the bias line. The Vptat is the voltage across a resistor that sums to a bandgap voltage with a Vbe. The emitter voltages at transistors 208 and 215 are about two times Vbg, or about 2.5 volts. The current coming out of the collector of transistor 113 shows Early effects with increasing supply voltage. The bandgap itself comprises NPN transistors 205, 206 and 207. The resistors 222 and 223 have been positioned to absorb the diode currents. Resistor 223 should be about twice the resistance of resistor 222. In accordance with an embodiment of the present invention, resistors 222 and 223 can be removed from the circuit, or made to have very low resistance. Transistors 206 and 207 have equal emitter areas to define matched voltages. The additional current through resistor 222 comes from transistor 205 through the bandgap resistor 221. The collector current of transistor 206 comes from the bandgap voltage. The collector of transistor 205 goes to the input of the cascoded PNP current mirror formed by transistors 208 and 209. The NPN diode 216 eliminates any Early voltage. The output current is duplicated in the collector of transistor 209 and absorbed by transistor 207. The output transistor devices 210 and 214 buffer the output voltage and do not cause sizeable loading errors. The beta of transistor 210 is about 2000 at the low currents provided by the PNP bias line. Advantageously, the output voltage can be run above 5 volts down to about 1.8 volts with +Vin 260 equal to about 2.05 volts. In experimental investigation, it was found that acceptable compensation was provided by a 2.2 micro farad capacitor from Vout 250 to ground.

Transistors 206 and 207 are substantially the same size, running at the same amount of current. Resistor 222, coupled to the emitter of transistor 206, is one half the resistance of resistor 223, coupled to the emitter of transistor 207. Consequently, the balance of the current in resistor 222 comes from transistor 221. Transistor 205 is four times the size of transistor 207. Transistor 208 is a divided collector PNP type transistor. Transistor 210 is a vertical PNP transistor with high beta. Transistor 210 picks up the voltage error and translates it up a diode, coupling it to the base of transistor 214. It is appreciated that the collector of transistor 214 produces the regulated output voltage, Vout 250.

Embodiments in accordance with the present invention are well suited to being produced in high voltage bi-polar silicon. When so made, such embodiments are well suited to use in vehicles, e.g., automobiles, that can have large transient voltages present at the input to such voltage regulators.

Embodiments in accordance with the present invention provide a system and method for a low dropout voltage regulator. Further embodiments in accordance with the present invention provide for a bandgap reference with a high power supply rejection ratio while requiring a small output filtering capacitor. Embodiments in accordance with the present invention provide for the above-mentioned capabilities in a manner that is complimentary and compatible with standard semiconductor processes.

Embodiments in accordance with the present invention, low dropout voltage regulator, are thus described. While the present invention has been described in particular embodiments, it should be appreciated that the present invention should not be construed as limited by such embodiments, but rather construed according to the below claims.

What is claimed is:

1. An integrated circuit low dropout voltage regulator comprising:

an output terminal for providing a regulated voltage output;

first and second transistors having their collectors coupled to said output terminal;

a first resistor having a first terminal coupled to the emitter of said first transistor;

a second resistor having a first terminal coupled to a second terminal of said first resistor;

a third resistor having a first terminal coupled to said second terminal of said second resistor;

a third transistor having a base terminal coupled to the emitter terminal of said second transistor and coupled to a second terminal of said third resistor;

a fourth transistor having a base terminal coupled to said second terminal of said first resistor; and wherein said third and fourth transistors are coupled in parallel.

2. The integrated circuit low dropout voltage regulator of claim 1 wherein said third resistor is substantially equal in resistance to that of said second resistor.

3. The integrated circuit low dropout voltage regulator of claim 2 wherein an emitter terminal of said third and said fourth transistors are coupled to a collector terminal of a split collector transistor device.

4. The integrated circuit low dropout voltage regulator of claim 3 wherein said third and said fourth transistors form an input to an operational amplifier.

5. The integrated circuit low dropout voltage regulator of claim 4 wherein said input does not substantially change current densities in said first or said second transistors.

6. The integrated circuit low dropout voltage regulator of claim 1 embodied in a high voltage bi-polar silicon semiconductor.

7. A low dropout voltage regulator comprising:

a proportional to absolute temperature (PTAT) circuit comprising a bipolar transistor for providing a substantially constant current and having a base, an emitter, and a collector;

a current sourcing bipolar transistor comprising a base, an emitter, and a collector coupled to said base of said current sourcing bipolar transistor and coupled to said collector of said bipolar transistor;

a first biasing bipolar transistor comprising a base coupled to said base of said current sourcing bipolar transistor, an emitter, and a collector;

a second biasing bipolar transistor comprising a base coupled to said base of said current sourcing bipolar transistor, an emitter, and a collector;

a third biasing bipolar transistor comprising a base coupled to said base of said current sourcing bipolar transistor, an emitter, and a collector; and a bandgap voltage generation circuit for generating a bandgap voltage, wherein said first, second, and third biasing transistors bias said bandgap voltage generation circuit.

8. The low dropout voltage regulator as recited in claim 7 wherein said bandgap voltage generation circuit comprises:

a first bandgap bipolar transistor having a base, an emitter, and a collector; and a second bandgap bipolar transistor having a base, an emitter, and a collector, wherein said collectors of said first and second bandgap bipolar transistors are coupled to a regulated output voltage.

9. The low dropout voltage regulator as recited in claim 8 wherein said bandgap voltage generation circuit further comprises:

a third bandgap bipolar transistor having a base, an emitter, and a collector; and a fourth bandgap bipolar transistor having a base, an emitter, and a collector, wherein said emitters of said third and fourth bandgap bipolar transistors are coupled to said collector of said first biasing bipolar transistor.

10. The low dropout voltage regulator as recited in claim 9 wherein said bandgap voltage generation circuit further comprises:

a current mirror circuit coupled to said collectors of said third and fourth bandgap bipolar transistors.

11. The low dropout voltage regulator as recited in claim 10 wherein said bandgap voltage generation circuit further comprises:

a fifth bandgap bipolar transistor having a base coupled to said collector of one of said third and fourth bandgap bipolar transistors, an emitter coupled to ground, and a collector coupled to said collector of said second biasing bipolar transistor.

12. The low dropout voltage regulator as recited in claim 11 wherein said bandgap voltage generation circuit further comprises:

a sixth bandgap bipolar transistor having a base coupled to said collector of said second biasing bipolar transistor, an emitter coupled to said collector of said third biasing bipolar transistor, and a collector coupled to ground.

13. The low dropout voltage regulator as recited in claim 12 wherein said base of third bandgap bipolar transistor is coupled to said emitter of one of said first and second bandgap transistors, and wherein said base of fourth bandgap bipolar transistor is coupled to said emitter of one of said first and second bandgap transistors.

14. A low dropout voltage regulator comprising:

a proportional to absolute temperature (PTAT) circuit comprising a current sourcing bipolar transistor comprising a base, an emitter, and a collector;

a voltage clamping bipolar transistor comprising a base coupled to a separately derived voltage, an emitter coupled to said collector of said current sourcing bipolar transistor, and a collector coupled to ground;

a current mirror circuit coupled to said collector of said current sourcing bipolar transistor; and a bandgap voltage generation circuit for generating a bandgap voltage, wherein said current mirror circuit sources current to said bandgap voltage generation circuit.

15. The low dropout voltage regulator as recited in claim 14 wherein said current mirror circuit comprises:

a first bipolar transistor having a base, an emitter coupled to said collector of said current sourcing bipolar transistor, and a collector; and a second bipolar transistor having a base coupled to said base of said first bipolar transistor, an emitter coupled to said collector of said current sourcing bipolar transistor, and a collector coupled to said base of said second bipolar transistor.

16. The low dropout voltage regulator as recited in claim 15 wherein said current mirror circuit further comprises:

a third bipolar transistor having a base, an emitter coupled, and a collector coupled to said collector of said first bipolar transistor and coupled to said base of said third bipolar transistor; and a fourth bipolar transistor having a base coupled to said emitter of said third bipolar transistor, an emitter coupled to said collector of said second bipolar transistor, and a collector.

17. The low dropout voltage regulator as recited in claim 14 wherein said bandgap voltage generation circuit comprises:

a first bandgap bipolar transistor having a base, an emitter, and a collector coupled to said current mirror circuit;

a second bandgap bipolar transistor having a base coupled to said base of said first bandgap bipolar transistor, an emitter, and a collector coupled to said base of said second bandgap bipolar transistor; and a third bandgap bipolar transistor having a base coupled to said base of said first bandgap bipolar transistor, an emitter, and a collector coupled to said current mirror circuit.

18. The low dropout voltage regulator as recited in claim 17 wherein said bandgap voltage generation circuit further comprises:

a fourth bandgap bipolar transistor having a base coupled to said collector of said third bandgap bipolar transistor, an emitter, and a collector coupled to group.

19. The low dropout voltage regulator as recited in claim 18 further comprising:

a bipolar transistor having a base coupled to said PTAT circuit, an emitter, and a collector coupled to said emitter of said fourth bandgap bipolar transistor.

* * * * *